United States Patent [19]

Laemmle et al.

[11] Patent Number: 4,522,250

[45] Date of Patent: Jun. 11, 1985

[54] CONTINUOUS CASTING WITH GLYCEROL TRIOLEATE PARTING COMPOSITION

[75] Inventors: Joseph T. Laemmle, Delmont; John Bohaychick, New Kensington, both of Pa.; Willie Lansdale, Newburgh, Ind.

[73] Assignee: Aluminum Company of America, Pittsburgh, Pa.

[21] Appl. No.: 454,268

[22] Filed: Dec. 29, 1982

[51] Int. Cl.[3] ..... B22D 11/07

[52] U.S. Cl. ..... 164/472; 427/133

[58] Field of Search ..... 164/472, 72, 121, 138; 427/133; 106/38.24

[56] References Cited

U.S. PATENT DOCUMENTS

| | | | |
|---|---|---|---|
| 2,045,913 | 6/1936 | Hoy et al. | 164/72 X |
| 3,034,186 | 5/1962 | Holshouser | 164/472 |
| 3,524,751 | 8/1970 | Smith et al. | 427/133 |
| 3,574,112 | 4/1971 | Nelson | 164/472 X |
| 3,620,290 | 11/1971 | Kress et al. | 164/472 |
| 3,640,860 | 2/1972 | Miller | 164/472 X |
| 4,157,728 | 6/1979 | Mitamura et al. | 164/452 |

FOREIGN PATENT DOCUMENTS 925070 4/1973 Canada .

OTHER PUBLICATIONS

*Handbook of Chemistry and Physics,* Chemical Rubber Co., 1969, p. C-314.

*Primary Examiner*—Nicholas P. Godici
*Assistant Examiner*—J. Reed Batten, Jr.
*Attorney, Agent, or Firm*—Glenn E. Klepac

[57] ABSTRACT

A process for continuously casting aluminum and aluminum alloys using a parting composition comprising glycerol trioleate. Both glycerol trioleate and mixtures of glycerol trioleate with castor oil have superior properties compared with parting compositions previously used for continuous ingot casting.

12 Claims, 1 Drawing Figure

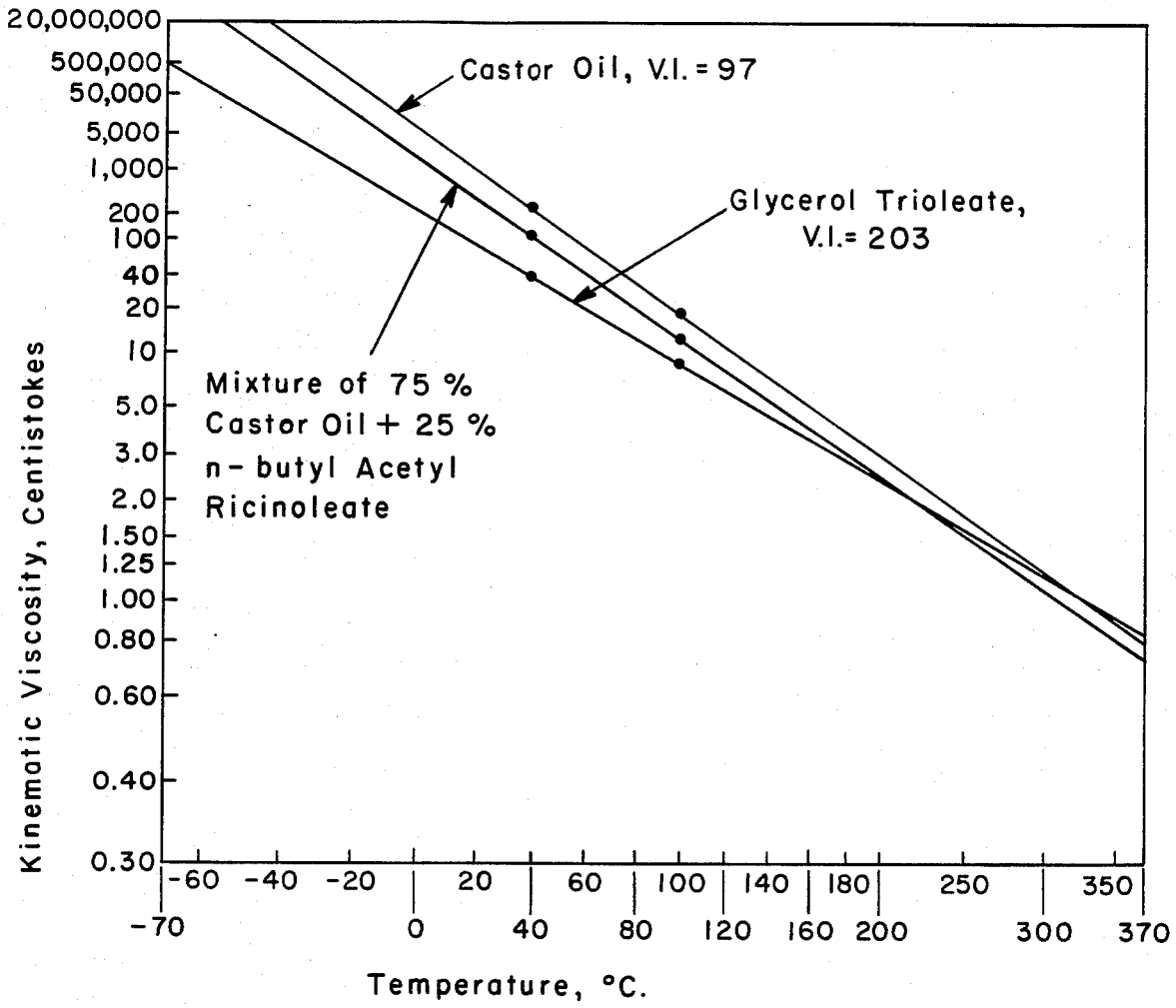
Castor Oil, V.I. = 97
Glycerol Trioleate, V.I.= 203
Mixture of 75 % Castor Oil + 25 % n-butyl Acetyl Ricinoleate
Kinematic Viscosity, Centistokes
20,000,000
500,000
50,000
5,000
1,000
200
100
40
20
10
5.0
3.0
2.0
1.50
1.25
1.00
0.80
0.60
0.40
0.30
-60 -40 -20 20 60 100 140 180 250 350
-70 0 40 80 120 160 200 300 370
Temperature, °C.

CONTINUOUS CASTING WITH GLYCEROL TRIOLEATE PARTING COMPOSITION

BACKGROUND OF THE INVENTION

The present invention relates to the use of synthetic glycerol trioleate or a mixture of materials containing substantial amounts of synthetic glycerol trioleate as a lubricant for use in casting ingots of aluminum and its alloys.

In the casting of aluminum and its alloys, it is customary to employ a mold lubricant and parting agent. Satisfactory ingot surface can be obtained only with a lubricant which has the ability to carry high loads at high temperatures. Until the mid-1950's, lard oil was commonly used as a mold lubricant for aluminum ingot casting. Mold design and lubricant application was not sophisticated and lard oil was often applied to molds by brushing or swabbing prior to casting. The principal disadvantage of lard oil is its tendency to harden to a grease-like consistency at approximately 40° F. This precluded its use in modern continuous casting methods where free flowing lubricant is required for cold weather operations. In addition, ingot cooling water interacts with lard oil to produce a grease-like material which can build up on continuous casting belts, interfere with ingot cooling and cause environmental difficulties. With the advent of advanced casting methods including continuous casting, castor oil has replaced lard oil as the most commonly used mold lubricant. Castor oil does not suffer the above-mentioned disadvantages of lard oil. However, castor oil is very viscous and difficult to apply to molds in a uniform fashion, especially in cold weather. In addition, castor oil is prone to undergo polymerization under casting conditions and deposit varnish-like films on molds and aluminum ingots leading to unsatisfactory surfaces and tears.

In order to perform satisfactorily on an industrial scale, a mold lubricant must meet several important requirements. Among these requirements are a viscosity at room temperature which allows easy and uniform application and a viscosity at mold-ingot interface temperatures sufficient to maintain a stable lubricant film. The lubricant must also have high resistance to thermal degradation. The lubricant must resist polymerization at high temperatures which lead to varnish-like deposits and unsatisfactory ingot surface. The lubricant must separate from ingot cooling water rapidly to avoid environmental contamination in discharge water and to avoid cooling problems in recirculated water. Aluminum ingot casting mold lubricants have generally not been able to satisfy all the foregoing requirements prior to the present invention.

Ingot casting lubricants are known in the prior art. Smith et al. U.S. Pat. No. 3,524,751 discloses an aluminum ingot casting lubricant comprising about 20 to 40% by weight of a lower alkyl ester of an acetylated hydroxy acid having 8 to 22 carbon atoms with about 80 to 60% by weight castor oil. A preferred embodiment involves a mixture of 25% n-butyl acetyl ricinoleate and 75% castor oil. This lubricant is marketed under the trade name Lubricin A-1.

Holshouser U.S. Pat. No. 3,034,186 discloses an aluminum ingot casting lubricant which consists of boric acid dispersed in a suitable oily or oily base material. In a preferred embodiment, 2 to 6% by weight of boric acid is mixed with lard oil.

Gardner Canadian Pat. No. 925,070 discloses polybutene and mixtures of polybutene with vegetable oil or animal oil and/or mineral oil which are predominantly polybutene, as a mold lubricant for aluminum ingot casting.

It is a principal object of the present invention to provide a mold lubricant for casting aluminum and its alloys having an ambient temperature viscosity which permits easy uniform application and a mold temperature viscosity sufficient to insure an uninterrupted lubricant film.

Related objects of the invention are to provide a lubricant accomplishing the foregoing objectives while at the same time having high thermal stability, good lubricity, rapid separation from ingot cooling water and avoidance of deposits on ingot and mold surfaces.

Additional objects and advantages of the present invention will become apparent to persons skilled in the art from the following specification.

SUMMARY OF THE INVENTION

In accordance with the present invention, there is provided a process for continuously casting aluminum and its alloys, using a lubricant having superior properties as a mold lubricant and parting agent.

The lubricant of this invention comprises synthetic glycerol trioleate, and it may include other materials that contribute special desirable properties where such properties are indicated. For example, it may be mixed with other animal or vegetable oils or with synthetic or petroleum oils to adjust its viscosity in specific temperature ranges.

The lubricant may also contain about 0.1–5 wt% of an oxidation inhibitor and/or an effective concentration of a biocide. One suitable oxidation inhibitor is 2,6-di-tert-butyl paracresol.

BRIEF DESCRIPTION OF THE DRAWING

FIG. 1 is a graph, showing extrapolated kinematic viscosity as a function of temperature for selected parting compositions.

DESCRIPTION OF THE PREFERRED EMBODIMENT

The preferred embodiment of the invention contains glycerol trioleate in which glycerol trioleate constitutes 25 to 100% of the lubricant by weight. Glycerol trioleate is a synthetic material sold under the trade name "EMEREST 2423" by Emery Industries of Cincinnati, Ohio, and "CPH-399-N" by C. P. Hall Company of Chicago, Ill. Particularly preferred embodiments of the invention include the use of glycerol trioleate alone or mixtures of glycerol trioleate and castor oil as mold lubricants and parting agents for casting ingots of aluminum and its alloys. The unusual and surprising properties of glycerol trioleate which allow its use as a superior mold lubricant will become apparent from the following description.

Mold lubricants for ingot casting must have viscosities at ambient temperature which allow them to be pumped easily and deliver a uniform lubricant film through the tiny passageways provided to allow lubricant to flow to the mold. In addition, such lubricants must have a viscosity at mold-ingot interface temperatures to provide a stable uninterrupted lubricant film. Table I gives the viscosities of the commonly used ingot casting lubricants, castor oil and a mixture comprising 75 wt% castor oil and 25 wt% n-butyl acetyl ricinoleate, along with the viscosities of glycerol trioleate and glycerol trioleate/castor oil mixtures at the standard temperatures of 40° C. and 100° C.

TABLE I

| Mold Lubricant Viscosities | | | |
|---|---|---|---|
| | Viscosity (cs) | | Viscosity Index |
| Lubricant. | 40° C. | 100° C. | (ASTM D2270) |
| Castor Oil | 260 | 19.8 | 97 |
| 25% n-butyl acetyl ricinoleate + 75% castor oil | 108 | 12.2 | 120 |
| Glycerol Trioleate | 39.9 | 8.4 | 203 |
| 25% Glycerol Trioleate + 75% Castor Oil | 155 | 15.5 | 118 |
| 50% Glycerol Trioleate + 50% Castor Oil | 93 | 12.4 | 138 |
| 75% Glycerol Trioleate + 25% Castor Oil | 58.7 | 10.1 | 173 |

The high viscosity of castor oil at 40° C., i.e. 260 cs, renders this material difficult to pump and apply, especially in cold weather. Mixing 75 wt% castor oil with 25 wt% n-butyl acetyl ricinoleate gives a less viscous lubricant but one which has disadvantages in reduced thermal stability and lubricity as will become apparent. Glycerol trioleate has a low 40° C. viscosity, i.e 39.9 cs. Thus, it can be pumped easily itself or mixed with castor oil to produce a lubricant with enhanced thermal stability and lubricity which has a viscosity tailored for maximum performance in a given delivery system. In addition, glycerol trioleate has a pour point of −8° C. (17° F.) and, therefore, does not produce the problematical grease-like deposits that are associated with lard oil.

The viscosity indexes of the above-mentioned lubricants are illustrated in Table I. The viscosity index is related to the change of viscosity with temperature. The higher the viscosity index, the less viscosity is reduced as temperature is increased. The surprising and unexpectedly high viscosity index of 203 for glycerol trioleate indicates that at mold-ingot interface temperatures, glycerol trioleate maintains a viscosity sufficient to provide a stable uninterrupted lubricant film.

One of the reasons for superior performance of glycerol trioleate is its favorable ambient temperature viscosity and very high viscosity index. This is further illustrated in a generally accepted extrapolation in FIG. 1 which shows that although glycerol trioleate has viscosity considerably lower than castor oil or a mixture of 75 wt% castor oil and 25 wt% n-butyl acetyl ricinoleate at ambient temperatures, its viscosity and film forming capabilities exceed those of the mixture and approach those of castor oil at mold-ingot interface temperatures.

Another property of ingot casting mold lubricants of great importance is thermal stability. This property is a measure of the resistance of the lubricant of vaporization or chemical degradation at high temperatures. Thermal degradation of lubricant to produce vapors in an ingot mold leads to several undesirable consequences. First, lubricants which vaporize more rapidly in the mold require more lubricant to maintain a stable film. This leads to costly higher lubricant usage in addition to greater varnish-like deposits. Second, vapors formed in the mold force separation of the ingot shell from the mold skirt, thereby reducing heat extraction at that point. Thirdly, in casting, where a ceramic header is used, vapors formed in the mold force lubricant into the ceramic header material forcing premature header deterioration. Lastly, in HDC and FDC casting, vaporization produces erosion of the oil ring and mold skirt leading to cracking of ingot surfaces.

TABLE II

| Thermal Stability (As Measured By Thermal Gravimetric Analysis) | | | | |
|---|---|---|---|---|
| | % Weight Loss Vs. Temperature | | | Maximum Weight Loss |
| Lubricant | 25% | 50% | 75% | Rate Temperature |
| Glycerol Trioleate | 752° F. | 779° F. | 811° F. | 802° F. |
| Castor Oil | 734° F. | 768° F. | 801° F. | 774° F. |
| Mixture comprising 25% n-butyl acetyl ricinoleate and 75% castor oil | 635° F. | 730° F. | 779° F. | 766° F. |
| n-butyl acetyl ricinoleate | 540° F. | 585° F. | 612° F. | 608° F. |

Table II illustrates the thermal stabilities of glycerol trioleate, castor oil, a mixture of 75 wt% castor oil with 25 wt% n-butyl acetyl ricinoleate and n-butyl acetyl ricinoleate as measured by thermal gravimetric analysis. In this generally accepted method of determining thermal stability, a small amount of material is placed on a microbalance in an inert atmosphere, and weight loss with respect to temperature is measured as the temperature is increased at a controlled rate. This method gives the percentage weight loss at a given temperature and the temperature at which the maximum rate of weight loss occurs. Lubricants in which a given percentage weight loss occurs at the higher temperature and in which the maximum rate weight loss occurs at the higher temperature are more thermally stable than lubricants in which these events occur at lower temperatures.

Table II illustrates that glycerol trioleate has the highest thermal stability of the lubricants measured. It should also be noted that n-butyl acetyl ricinoleate has a relatively low thermal stability. Thus, glycerol trioleate can be mixed with castor oil to produce a lubricant with lower ambient viscosity and less tendency to produce varnish while enhancing rather than sacrificing thermal stability, a major improvement over the previously known art. To illustrate the advantages, aluminum alloy 5182 was cast on a commercial size HDC unit (21"×42" ingot) at approximately 4 in/min employing first a mixture comprising 25% n-butyl acetyl ricinoleate and 75% castor oil and then a mixture of 75% glycerol trioleate and 25% castor oil. It required a lubricant flow of about 30 ml/min for the castor oil/n-butyl acetyl ricinoleate mixture to produce a satisfactory ingot, whereas a lubricant flow of about 9 ml/min of the glycerol trioleate/castor oil mixture produced satisfactory ingot.

Still another required property of ingot casting mold lubricants is rapid separation from ingot cooling water. This is required in discharged waste cooling water for environmental reasons. In addition, in systems where cooling water is recirculated, unremoved mold lubricant has a deleterious effect on cooling. Two factors influence the ability of lubricants to separate from water. Firstly, the less dense the lubricant is compared to water, the greater its buoyancy force and the more rapidly separation from water occurs. Secondly, lubricants which have hydroxyl groups capable of hydrogen bonding with water will separate less rapidly. As illustrated in Table III, glycerol trioleate has a lower density than either castor oil or the mixture comprising 25% n-butyl acetyl ricinoleate and 75% castor oil. Glycerol trioleate contains no hydroxyl groups and, therefore, provides a further advantage over those previously known lubricants.

TABLE III

| Lubricant | Oil-Ingot Water Separation Density (g/ml) | Hydroxyl Groups |
|---|---|---|
| Glycerol Trioleate | 0.908 | No |
| Castor Oil | 0.961 | Yes |
| Mixture comprising 25% n-butyl acetyl ricinoleate and 75% castor oil | 0.952 | Yes |

Other esters of oleic acid, as well as esters of ricinoleic acid and esters of ricinoleic acid in which the 12-hydroxyl group had been acetylated were compared to glycerol trioleate in casting trials. Aluminum 5182 alloy was cast for 4 hours where possible employing each of the test lubricants using an HDC unit casting a 6-inch diameter billet. Lubricant flow was varied from very high to very low rates, and those lubricants in which the flow rate could be varied over the widest interval and still give acceptable ingot were judged to be best. The results, shown in Table IV, illustrate the superior results obtained with glycerol trioleate.

TABLE IV

| Lubricants Listed According to Decreasing Lubricity[1] |
|---|
| 1. Glycerol Trioleate |
| 2. Castor Oil |
| 3. Ethyl Oleate |
| 4. Methyl Oleate |
| 5. Butyl Ricinoleate |
| 6. Methyl Ricinoleate |
| 7. Methyl Acetyl Ricinoleate |
| 8. Butyl Oleate |
| 9. Glycerol Triacetyl Ricinoleate |
| 10. Butyl Acetyl Ricinoleate |

Also as illustrated by Table IV, acetylated esters of ricinoleic acid gave extremely poor results. Thus, attempts to lower the viscosity and control the varnish deposits attributed to castor oil by adding n-butyl acetyl ricinoleate does so at the expense of thermal stability as illustrated by Table II and at the expense of lubricity as illustrated by Table IV. The lubricant of the present invention enhances both thermal stability and lubricity compared to castor oil.

Preferred compositions of the lubricant include 100% pure glycerol trioleate and mixtures of glycerol trioleate and castor oil where glycerol trioleate comprises at least 25% of the mixtures. In addition, additives known to persons skilled in the art may be added. Such additives may include biocides and oxidation inhibitors among others.

EXAMPLES

Some examples of preferred lubricant compositions made in accordance with the invention are as follows:

| Example | Ingredient | Content |
|---|---|---|
| 1 | Glycerol Trioleate | 100.0% |
| 2 | Glycerol Trioleate | 99.5% |
| | BHT (oxidation inhibitor) | 0.5% |
| 3 | Glycerol Trioleate | 75.0% |
| | Castor Oil | 25.0% |
| 4 | Glycerol Trioleate | 74.5% |
| | Castor Oil | 25.0% |
| | BHT (oxidation inhibitor) | 0.5% |

The lubricant of Example 1 has been used to cast commercial size HDC and DC ingot. In the case of HDC ingot, no deposits appeared on the mold skirt or ingot. Recovery was judged to be excellent. In the case of DC ingot, lubricant consumption was about 30% of the consumption for similar castings using castor oil, with low ingot tear rates and excellent recovery.

The lubricant of Example 3 has also been used to successfully cast both DC and HDC ingot. In addition to the previously mentioned comparison with a castor oil/n-butyl acetyl ricinoleate mixture, it has been found to cast excellent ingot in a commercial size HDC billet and bar castor which casts 6-inch square ingot, 6-inch diameter ingot and 5-inch by 3-inch rectangular ingot. This unit previously employed castor oil and lubricant consumption was reduced by 50% by employing the lubricant of Example 3. The lubricant of Example 3 has also been used to cast commercial size ingots of 7050 alloy, 2219 alloy, 6009 alloy and 2024 alloy in a commercial size rectangular DC casting unit. The thick oil coating and buildup on the mold seen with castor oil while operating this unit never occurred when employing the lubricant of Example 3.

The foregoing description of our invention has been made with reference to a few preferred embodiments. Persons skilled in the art will understand that changes and modifications can be made in the invention without departing from the spirit and scope of the following claims.

What is claimed is:

1. A process for the continuous casting of aluminum and its alloys wherein molten metal is cast into a cooled mold having a lubricated inner mold wall, said process comprising the steps of (a) lubricating an inner wall of a cooled, continuous casting mold with a parting composition consisting essentially of at least about 50 wt% glycerol trioleate, about 0–5 wt% of an oxidation inhibitor and about zero to an effective concentration of a biocide, and (b) casting a molten metal comprising aluminum or an aluminum base alloy into said mold, whereby said parting composition reduces the frequency of hot tears on the surface of the cast metal and has a reduced consumption rate.

2. The process of claim 1 wherein said parting composition further consists essentially of up to about 50 wt% of another animal, vegetable, mineral or synthetic oil.

3. The process of claim 1 wherein said parting composition further consists essentially of up to about 50 wt% castor oil.

4. The process of claim 3 wherein said parting composition consists essentially of about 50–100 wt% glycerol trioleate and about 0–50 wt% castor oil.

5. The process of claim 3 wherein said parting composition consists essentially of about 70–100 wt% glycerol trioleate and about 0–30 wt% castor oil.

6. The process of claim 3 wherein said parting composition consists essentially of about 75 wt% glycerol trioleate and about 25 wt% castor oil.

7. The process of claim 1 wherein said parting composition contains about 0.1–5 wt% of an oxidation inhibitor.

8. The process of claim 7 wherein said oxidation inhibitor comprises 2,6-di-tert-butyl paracresol.

9. The process of claim 1 wherein said parting composition contains an effective concentration of a biocide.

10. A process for the continuous casting of aluminum and its alloys wherein molten metal is cast into a cooled mold having a lubricated inner mold wall, said process comprising the steps of (a) lubricating an inner wall of a cooled continuous casting mold with a parting composition consisting of at least about 50 wt% glycerol trioleate, up to about 50 wt% of another animal, vegetable, mineral or synthetic oil, about 0–5 wt% of an oxidation inhibitor and about zero to an effective concentration of a biocide, and (b) casting a molten metal comprising aluminum or an aluminum base alloy into said mold, whereby said parting composition reduces the frequency of hot tears on the surface of the cast metal and has a reduced consumption rate.

11. The process of claim 10 wherein said parting composition consists of about 50–100 wt% glycerol trioleate and up to about 50 wt% castor oil.

12. The process of claim 10 wherein said parting composition consists of about 70–100 wt% glycerol trioleate and about 0–30 wt% castor oil.

* * * * *

UNITED STATES PATENT AND TRADEMARK OFFICE

CERTIFICATE OF CORRECTION

PATENT NO. : 4,522,250

DATED : June 11, 1985

INVENTOR(S) : Joseph T. Laemmle, John Bohaychick and Willie Lansdale

It is certified that error appears in the above—identified patent and that said Letters Patent is hereby corrected as shown below:

| | |
|---|---|
| Col. 2, line 39 | Change "Fig. 1" to --The drawing--. |
| Col. 5, line 39 | Insert the following paragraph: --(1) As determined by HDC Castings of 6-Inch Diameter 5182 Alloy.-- |

Signed and Sealed this

*Seventeenth* Day of *September 1985*

[SEAL]

*Attest:*

*Attesting Officer*

DONALD J. QUIGG

*Commissioner of Patents and Trademarks—Designate*